United States Patent [19]

Birke et al.

[11] 4,428,750

[45] Jan. 31, 1984

[54] PROCESS FOR THE LOCALIZED LIGHTENING, WHITE DISCHARGING OR COLORED DISCHARGING OF DYEINGS ON TEXTILE SHEET-LIKE STRUCTURES USING DYE DISSOLVING AGENT

[75] Inventors: Walter Birke; Hans-Ulrich von der Eltz; Franz Schön, all of Frankfurt am Main; Erich Feess, Hofheim am Taunus, all of Fed. Rep. of Germany

[73] Assignee: Hoechst Aktiengesellschaft, Frankfurt am Main, Fed. Rep. of Germany

[21] Appl. No.: 467,956

[22] Filed: Feb. 18, 1983

Related U.S. Application Data

[63] Continuation of Ser. No. 327,584, Dec. 4, 1981, abandoned, which is a continuation of Ser. No. 154,526, May 29, 1980, abandoned.

[30] Foreign Application Priority Data

Jun. 1, 1979 [DE] Fed. Rep. of Germany ..... 2922373
Jul. 14, 1979 [DE] Fed. Rep. of Germany ..... 2928601

[51] Int. Cl.[3] ..... D06P 5/15
[52] U.S. Cl. ..... 8/461; 8/464; 8/532; 8/582; 8/609; 8/610; 8/922
[58] Field of Search ..... 8/461, 464, 532, 609, 8/610

[56] References Cited

U.S. PATENT DOCUMENTS 3,582,255 6/1971 Kissling ..... 8/102
3,972,677 8/1976 Feess et al. ..... 8/464

FOREIGN PATENT DOCUMENTS 50-14886 2/1975 Japan .
626419 7/1949 United Kingdom .
1440904 6/1976 United Kingdom .
1494329 12/1977 United Kingdom .

*Primary Examiner*—A. Lionel Clingman
*Attorney, Agent, or Firm*—Curtis, Morris & Safford

[57] ABSTRACT

In order to achieve lighter patterned effects on a background of a deeper color, aqueous printing pastes containing, additionally to thickeners and other conventional printing assistants, assistants which have dissolving properties for the dyestuffs at elevated temperatures and which do not attack the fibers under thermosol conditions, are applied to textile webs which have been dyed in a finished manner with suitable dyestuffs or have only been impregnated therewith, after which the goods treated in this way are subjected to a steaming process or to a dry heat treatment. In accordance with the process it is possible to effect a uniform lightening, "white discharging" or "colored discharging" of dyeings, particularly dyeings of synthetic fibers with disperse dyestuffs and also dyeings of natural fibers or mixtures thereof with disperse dyestuffs, vat dyestuffs, leuco esters thereof and developing dyestuffs. Dyestuff-dissolving assistants of the type used are anionic, cationic or nonionic compounds of various structures.

10 Claims, No Drawings

PROCESS FOR THE LOCALIZED LIGHTENING, WHITE DISCHARGING OR COLORED DISCHARGING OF DYEINGS ON TEXTILE SHEET-LIKE STRUCTURES USING DYE DISSOLVING AGENT

This is a continuation of application Ser. No. 327,584, which is a continuation of Ser. No. 154,526 filed Dec. 4, 1981 and May 29, 1980, respectively both now abandoned.

The present invention relates to the localized lightening, "white discharging" or "colored discharging" of dyeings on textile sheet-like articles with a fibrous structure which have been dyed in a finished manner with dyestuffs suitable for the type of fiber present or have only been impregnated therewith and dried, the dyestuffs not yet having been fixed.

Besides the direct printing method for putting a pattern on sheet-like textile material, principally in shades of deeper colors, a variety of printing techniques for producing lighter patterned effects are known, by means of which it is possible to obtain white and colored effects on dyeings previously effected. Examples are:

(1) white discharging and colored discharging, wherein the fiber material is in the form of a finished ground dyeing effected with dischargeable dyestuffs,
(2) discharge resisting as white and colored discharging, dischargeable dyestuffs having previously been applied to the fiber material, but not yet fixed, and
(3) resist processes, wherein the fiber material is preprinted with white or colored resists before being dyed.

All these processes for imparting a pattern are based on the principle that the dyestuffs are destroyed locally at the areas which have been printed with the discharge pastes. This is effected in the course of a heat treatment which follows the printing process and which is in most cases a steaming process, but in some cases is also a treatment with hot air. In discharge resisting and resisting processes, the fixation of the dyestuff on the background which has not been printed with discharge pastes is also effected at the same time during this heat treatment. In the case of colored discharging, dyestuffs resistant to discharging are printed on at the same time as the discharge paste and these dyestuffs then dye the fiber locally at the same places, instead of the dyestuffs which have been destroyed. In addition to dyestuffs, which are resistant to discharging, of the same category, it is also possible to employ dyestuffs of other classes.

Suitable products for destroying dyestuffs in the discharge pastes according to the state of the art are reducing agents, such as, for example, stabilized hydrosulfite compounds or tin salts, or alkalis, for example, sodium hydroxide solution. In addition, in many cases discharge-intensifying products, such as carriers or anthraquinone, are used concomitantly in such discharge pastes.

It ranks as a considerable disadvantage for all these known processes in which products which destroy dyestuffs are used selectively, that uniform lightening effects cannot be achieved therewith and that white effects are only possible in accordance with the individual processes (1) to (3) if a small number of dyestuffs are used in each case.

The object of the present invention therefore consists in conceiving a simple process in accordance with which it is possible to achieve dyeings which have lighter patterned effects or "white or colored discharge", without the occurence of the disadvantages, described earlier in the text, of the known procedure and/or without having to accept the limitations imposed thereby.

This object is now achieved, in accordance with the invention, (1) by applying, to the textile materials which have been treated with the dyestuffs, printing pastes which, in addition to thickeners, other customary printing assistants and water, also contain assistants which have solvent properties for the dyestuffs concerned at elevated temperatures and which do not themselves attack the fiber substances of the textile material under thermosol conditions, that is to say at the temperature of the heat treatment (180°–220° C.), and
(2) by carrying out a heat treatment after the application of the printing paste.

The process described above is suitable primarily for the treatment, according to the invention, of dyeings with disperse dyestuffs on textile webs made of synthetic fibers. Examples of fiber materials of this type, of synthetic origin, which are suitable for use in accordance with the present invention are fabrics of polyamide fibers, polyacrylonitrile fibers or cellulose triacetate fibers and, in particular, fabrics made of polyester fibers, such as polyethylene terephthalate fibers.

The disperse dyestuffs which are employed for this purpose, such as azo, anthraquinone, quinophthalone or benzthioxanthene dyestuffs, are adequately known and are described in the COLOUR INDEX, 3rd Edition (1971), Volume 2 under the class designation "Disperse Dyes".

However, the new process is also suitable for the production of the effects described on textiles made of natural fibers or mixtures thereof with synthetic fibers, which have been dyed or impregnated with disperse dyestuffs, vat dyestuffs, leuco-esters thereof or developing dyestuffs. Suitable textile articles of this type are, as regards those made of natural fibers, primarily cellulose fiber materials and, as regards those made of mixtures of natural fibers with synthetic fibers, mixtures of cellulose fibers with polyamide fibers, cellulose triacetate fibers or, especially, polyester fibers, such as polyethylene terephthalate fibers.

The dyestuffs mentioned above are adequately known and are described in the COLOUR INDEX, 3rd Edition (1971), Volume 2 under the class designations "Disperse Dyes", "Vat Dyes", "Soluble Vat Dyes" and "Azoic Coupling Components/Azoic Diazo Components".

The process claimed can be used in the case of cellulose fibers which have been dyed with vat dyestuffs, leuco-esters thereof or developing dyestuffs or which have been impregnated (with the coupling component of developing dyestuffs), or in the case of mixtures of cellulose fibers with synthetic fibers, which have been dyed or impregnated with disperse dyestuffs, vat dyestuffs or leuco-esters thereof.

In the series of disperse dyestuffs, only those which also dye the cellulose fibers under thermosol conditions can be used for mixed fabrics.

The new process is carried out by employing, in the printing pastes, in addition to the conventional thickeners, other conventional printing auxiliaries and water, assistants of a different structure or mixtures of these assistants which have solvent properties at elevated temperatures for the dyestuffs applied as a background and which do not themselves attack the particular type of fiber under thermosol conditions.

Characteristic, dyestuff-dissolving auxiliaries which can be used in accordance with the process are compounds of an anionic, cationic or nonionic nature. Examples of compounds which are employed are fatty acid sarcosides, fatty acid/protein condensation products, sulfonated oils, salts of alkylsulfamidocarboxylic acids, alkyl sulfates, alkylsulfonates, alkylphenol polyglycol ether-sulfonates, phosphoric acid esters, glycols, polyglycols, oxyalkylated fatty amines, fatty alcohols or fatty acids or alkylaryl polyglycol ethers, such as alkylphenol polyglycol ethers, the alkylene oxides which have been added on being predominantly ethylene oxide or mixed oxalkylates of the compounds mentioned, for example, those formed from ethylene oxide and propylene oxide.

It is possible to discover in a simple manner, by means of preliminary experiments, which of the products envisaged as a dyestuff-dissolving assistant must be used and the quantities of the particular product and the nature of the heat treatment required for the desired effects. The specific effectiveness of the substances to be selected for the purpose intended can be determined by the following test method:

Printing pastes are prepared, which, in addition to the conventional proportions of water, thickeners and, if appropriate, other additives, contain, for example, 20, 50 and 200 g of the assistant to be tested per kg. These printing pastes are used to print the test fabric which has been dyed in a finished manner or merely impregnated with the dyestuffs (commercial form) intended for dyeing the background. After printing, the test dyeings which have been treated in this way are subjected to thermosol treatment for 90–120 seconds at 210° to 215° C. and are then rinsed in the conventional manner and subjected to reductive afterscouring. On the basis of the results obtained, it is then possible to assess whether the assistant concerned is suitable only for lightening effects or for both lightening effects and white effects.

While a large number of dyestuff-dissolving products of very different structures are suitable for lightening effects, those suitable for white effects are principally oxalkylated compounds, preferably oxethylated fatty alcohols, fatty acids or alkylphenols and especially those having 5 to 40 moles of ethylene oxide per mole of base substance. Fatty alcohols having 8 to 18 carbon atoms which have been oxethylated with 5 to 40 moles of ethylene oxide per mole of the alcohol are particularly useful for this purpose.

The quantities of the dyestuff-dissolving assistants to be used in the printing pastes and the mode of carrying out the new process depend on the effects which are to be achieved. Depending on whether slight or strong lightening effects or white effects are desired, quantities between 5 and 200 g of product having the properties mentioned are suitable for use per kg of printing paste.

In addition, the nature of the heat treatment plays an important part as regards the results desired. A thermosol treatment is primarily suitable for this purpose. If only lightening effects are intended, the heat treatment can also be carried out in the form of a steaming process.

If the printing procedure is followed by a steaming process, lightening effects are, therefore, mainly achieved, and white effects are generally not obtained. Steaming can be carried out, for example, for 20–30 minutes under a pressure of 1.5–2 atmospheres gauge (as a rule in a star ager), for about 8 minutes in superheated steam at 170°–180° C. (for example in a festoon ager) or about 10 minutes in saturated steam at about 102° C. (in a star ager). On the other hand, white effects are achieved if the printing procedure is followed by a dry heat treatment such as is customary for fixing disperse dyestuffs on polyester fibers after the so-called thermosol process, for example heating under dry conditions at 180°–220° C. for about two minutes. The dry heat treatment can be carried out, for example, by means of hot air, radiated heat and/or contact heat (conducted via heated metal cylinders). Finally, it is possible, in accordance with the invention, to effect the heat treatment which follows the application of the printing paste, in the form of a combined dry heat and steam treatment.

Furthermore, a factor of importance for the effects desired is the stage of processing reached by the textiles to be treated in accordance with the process, that is, whether they are in the form of a finished dyeing or in a condition in which they have only been impregnated with the dyestuff and dried. If they are polyester fiber materials on which the disperse dyestuffs are present in an as yet non-fixed form, mainly lightening effects are obtained and less often white effects. In this case the fixing of the dyestuff is carried out in a thermosol process following the printing procedure. Good white effects are, however, achieved by the new process if finished dyeings containing disperse dyestuffs on polyester fiber materials are used. The method by which the dyeings have been produced is not important in this respect; that is to say the desired white effect is obtained whether HT dyeings, carrier dyeings, thermosol dyeings or dyeings effected from organic solvents are used.

The superiority of the new process is, above all, substantiated by the fact that it enables very uniform lightening effects to be produced, it being possible to affect the degree of lightening desired, as a function of the depth of shade available, by the nature and quantity of the dyestuff-dissolving assistant and by the nature and duration of the heat treatment which follows the printing process.

It is also a decisive advantage of the new process that, precisely when finished dyeings are used, a substantially larger number of disperse dyestuffs can be white "discharged" than has been the case in the methods previously known for this purpose. In addition, for achieving white effects, it can be emphasized as a further gain that a protracted steaming process is not required in accordance with the invention, but only a brief dry heat treatment. This has the additional advantage that the printed goods can be moved without contact during the heat treatment, for example in a stenter frame, which is not possible in a steamer.

A further considerable benefit of the working technique claimed is afforded by the fact that the cost of a brief dry heat treatment is markedly less than that of the methods hitherto customary for the purpose mentioned. In addition, the new process can be carried out using relatively simple machinery and equipment (for example a magnetic doctor blade in rotary screens) in dye houses, in which the machines required for the application of dry heat are virtually always available, while the steamers used for fixing by the conventional printing processes are not available in dyeing plants to nearly the same extent as in printing plants.

In addition, depending on the nature and quantity of the assistant, further interesting effects can be achieved in accordance with the present invention. If only small quantities of dyestuff-dissolving assistant, for example 5–50 g per kg of printing paste, are employed, the dyestuff applied as a background migrates, in the course of the heat treatment, from the printed area of the textile material to the reverse side. In accordance with the new procedure, it is thus possible to effect not only white and lightening effects, but also color-intensifying effects, for example in cases where the underside of the material is surface-printed.

In the case of "white discharging", for which-as already described earlier in the text-the printing of finished polyester fiber dyeings and subsequent dry heat treatment is the most suitable method, it is additionally possible also to add small quantities of the known discharging agents or discharge assistants to the printing pastes containing the dyestuff-dissolving assistant. By this means it becomes possible to keep the large quantities of product required for white effects at a somewhat lower level, a combined dry heat/steam treatment being suitable for thermofixing under such conditions.

In the case of "colored discharging" it is surprising that dyestuffs of the same category can be employed both as "dischargeable" dyestuffs and as dyestuffs which are "resistant to discharging". Thus, for example, it is possible without difficulty by means of the disperse dyestuff B "to discharge, with the production of a color", a background dyeing which has been produced with the disperse dyestuff A or, conversely, by means of the disperse dyestuff A "to discharge, with the production of a color" a background dyeing which has been produced with the disperse dyestuff B. In this respect it is, of course, in the nature of the invention that the background should not be an excessively dark dyeing and that only a reduced tinctorial yield is obtained in the case of the disperse dyestuffs which are employed in the "colored discharge pastes".

For practical purposes, the only limitations applying to "colored discharging" by means of other classes of dyestuffs, such as, for example, vat dyestuffs or leucoesters thereof, are that it is necessary to select dyestuffs which can be fixed by a dry heat process or to carry out a combined dry heat and steam treatment.

EXAMPLE 1

A fabric made of texturized polyester fibers, which has been dyed with 2% of the orange disperse dyestuff C.I. No. 26,077 (Disperse Orange 29), is printed with a printing paste containing, per kg, the following constituents:

100 g of oxethylated castor oil (36 moles of ethylene oxide),
35 g of a sodium alginate,
12 g of a starch ether,
6 g of a water softening agent based on polyphosphate,
1 g of citric acid and
the remainder water.

After printing, the goods are steamed at 180° C. in an HT steamer for 8 minutes and are then washed. This gives a print in which the printed areas have been distinctly lightened.

The compositions of the printing pastes for the following examples correspond to those of Example 1, it being necessary to make slight alterations in the quantities of thickeners and water, depending on the assistants used in these examples, in order to obtain pastes suitable for printing.

EXAMPLE 2

A fabric made of texturized polyester fibers is dyed at 130° C. for 60 minutes under HT conditions by the exhaustion process using 1% of the red disperse dyestuff of the formula

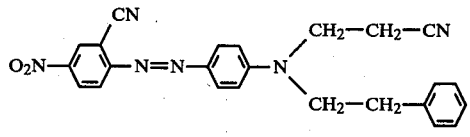

and is then subjected to reductive afterscouring in the customary manner. The finished, dried dyeing is then printed with a printing paste containing, per kg, 150 g of oxethylated stearyl alcohol (25 moles of ethylene oxide per mole of alcohol). After printing, the fabric is subjected to thermosol treatment for 2 minutes at 215° C. and is then rinsed. This gives a print in which the printed areas are white.

Examples 3 to 11 which follow are carried out in a manner corresponding to that of Example 2. In all cases, results similar to that Example are obtained, the following dyestuffs being used for dyeing (the percentages relate to the weight of the polyester fiber to be dyed):

EXAMPLE 3

1% of the red disperse dyestuff C.I. No. 60,756 (Disperse Red 60).

EXAMPLE 4

2% of the red disperse dyestuff C.I. No. 11,116 (Disperse Red 73).

EXAMPLE 5

2% of the blue disperse dyestuff C.I. No. 63,285 (Disperse Blue 56).

EXAMPLE 6

1% of the blue disperse dyestuff C.I. No. 63,265 (Disperse Blue 73).

EXAMPLE 7

1% of the yellow disperse dyestuff C.I. No. 47,023 (Disperse Yellow 64).

EXAMPLE 8

1% of the yellow disperse dyestuff of the formula

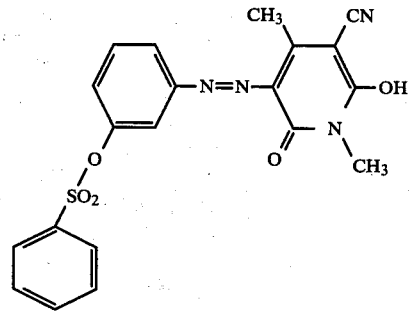

EXAMPLE 9

3% of the blue disperse dyestuff of the formula

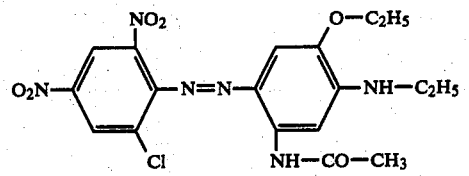

EXAMPLE 10

1% of the violet disperse dyestuff of the formula

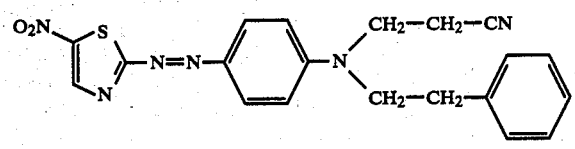

EXAMPLE 11

2% of the green disperse dyestuff C.I. No. 56,060 (Disperse Green 1).

EXAMPLE 12

20 g of the yellow disperse dyestuff of the formula

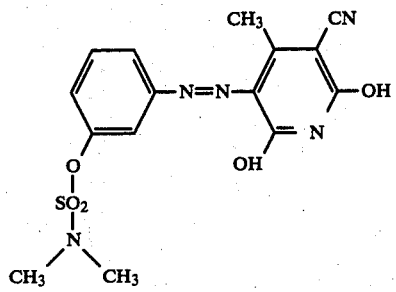

are dispersed in 1 liter of water. This padding liquor is used to pad a fabric made of texturized polyester fibers on a padder at a liquor pick-up of 60%. After padding, the fabric is dried at 110° C. and is then subjected to thermosol treatment for 1 minute at 220° C. The dyeing is then finished by rinsing and reductive afterscouring. It is treated further as described in Example 2. This gives a print in which the printed areas are white.

EXAMPLE 13

10 g of the blue disperse dyestuff C.I. No. 11,077 (Disperse Blue 165) are dispersed in 1 liter of water. This padding liquor is used to pad a fabric made of texturized polyester fibers on a padder at a liquor pick-up of 60%. After padding, the fabric is dried at about 100° C. The fabric is then printed with a printing paste containing, per kg, 200 g of oxethylated coconut fatty alcohol (25 moles of ethylene oxide per mole of alcohol). The printed goods are then subjected to thermosol treatment for 2 minutes at 215° C.; in the course of this the fixing of the dyestuff at the areas which have not been printed is effected simultaneously.

The printed goods are finished by rinsing and reductive afterscouring. This gives a print in which the printed areas are white.

EXAMPLE 14

A fabric made of texturized polyester fibers which has been dyed with 1% of the violet disperse dyestuff C.I. No. 62,025 (Disperse Violet 26) is printed with a printing paste containing, per kg, 150 g of oxethylated stearyl alcohol (25 moles of ethylene oxide per mole of alcohol) and 40 g of Decrolin. After printing, the fabric is first steamed for 5 minutes in an HT steamer at 180° C. and is then subjected to thermosol treatment for 2 minutes at 210° C. Finishing in the customary manner gives a print which is white at the printed areas.

EXAMPLE 15

A fabric made of texturized polyester fibers which has been dyed with 2% of the red disperse dyestuff from Example 2, is printed on the underside of the material with a printing paste containing, per kg, 20 g of a secondary alkylsulfonate. The printed fabric is then subjected to thermosol treatment for 2 minutes at 220° C. and is washed. This gives a print in which the printed areas have been lightened, while the reverse side of the printed areas, that is to say the upper side of the material, exhibits a deepening of color.

Similar results are obtained in accordance with Examples 16 to 20 which follow, if the dyestuffs and/or assistants mentioned therein are employed and the procedure followed is in other respects as described in the present Example.

EXAMPLE 16

2% of the orange disperse dyestuff described in Example 1 and 20 g/kg of the sodium salt of an alkylsulfamidocarboxylic acid.

EXAMPLE 17

2% of the orange disperse dyestuff described in Example 1 and 25 g/kg of a sodium alkylphenol polyglycol ether-sulfate.

EXAMPLE 18

1% of the blue disperse dyestuff described in Example 13 and 50 g/kg of a condensation product formed from partially degraded casein and oleyl chloride.

EXAMPLE 19

1% of the blue disperse dyestuff described in Example 13 and 40 g/kg of an alkylphenol polyglycol ether-sulfonate.

EXAMPLE 20

1% of the blue disperse dyestuff described in Example 13 and 20 g/kg of a polyglycol with an average molecular weight of 1,000.

EXAMPLE 21

A fabric made of texturized polyester fibers which has been dyed with 2% of the orange disperse dye-stuff described in Example 1, is printed with a printing paste containing, per kg, 120 g of a coconut fatty amine oxethylated with 10 moles of ethylene oxide. After printing, the fabric is subjected to thermosol treatment for 2 minutes at 210° C. and is then rinsed. This gives a print which has been distinctly lightened at the printed areas.

Similar results are achieved in accordance with Examples 22 to 25 which follow, if the products listed in the following Examples are employed instead of the dyestuff and assistant indicated in the present Example and if the procedure followed is in other respects as described in the present Example, the percentages relating to the weight of the polyester fiber material to be dyed.

EXAMPLE 22

2% of the orange disperse dyestuff described in Example 1 and 100 g/kg of an oxethylated nonylphenol (containing 6 moles of ethylene oxide).

EXAMPLE 23

2% of the red disperse dyestuff described in Example 2 and 100 g/kg of an oleylamine oxethylated with 20 moles of ethylene oxide.

EXAMPLE 24

2% of the red disperse dyestuff described in Example 2 and 80 g/kg of an oleic acid polyglycol ester (6 moles of ethylene oxide per mole of acid).

EXAMPLE 25

2% of the red disperse dyestuff described in Example 2 and 150 g/kg of a polymerization product formed from propylene oxide and ethylene oxide.

EXAMPLE 26

A fabric made of texturized polyester fibers which has been dyed with 2% of the red disperse dyestuff of the formula

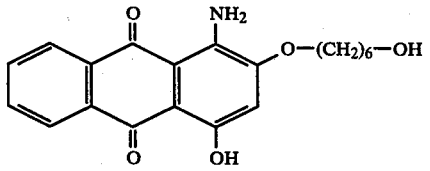

is printed with a printing paste containing, per kg, 100 g of oxethylated stearyl alcohol (20 moles of ethylene oxide per mole of alcohol). After printing, the goods are first dried at about 100° C. and are then steamed in an HT steamer for 7 minutes at 180° C. Rinsing in the customary manner gives a print which has been distinctly lightened at the printed areas.

EXAMPLE 27

A result similar to that according to Example 26 is obtained if the following products are employed instead of the dyestuff and assistant mentioned in that Example:

2% of the blue disperse dyestuff of the formula

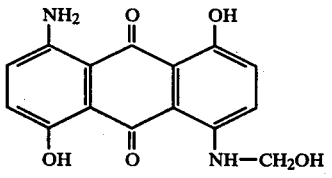

and 150 g/kg of oxethylated castor oil (30 moles of ethylene oxide).

EXAMPLE 28

A dyeing is first produced on texturized polyester fabric by the exhaustion process under HT conditions, using 0.1% of the yellow disperse dyestuff described in Example 8. This dyeing is printed with a printing paste containing, per kg, 200 g of oxethylated stearyl alcohol (25 moles of ethylene oxide per mole of alcohol) and 10 g of the blue disperse dyestuff from Example 13. After printing, the fabric is subjected to thermosol treatment for 2 minutes at 215° C. and is rinsed and subjected to reductive afterscouring. This gives a blue print on a yellow background shade.

EXAMPLE 29

Conversely, a yellow print on a blue background shade is obtained if the dyestuffs listed in Example 28 are exchanged with one another.

If the procedure followed is as described in Examples 28 and 29, the results mentioned in the below Examples are obtained on using the dyestuffs indicated in Examples 30 to 32 which follow.

EXAMPLE 30

A blue print on a red background shade.

Dyeing: produced using 0.5% of the red disperse dyestuff described in Example 2.

Printing paste: prepared using 20 g/kg of the blue vat dyestuff C.I. No. 70,507 (Vat Blue 67).

EXAMPLE 31

A yellow print on a red background shade.

Dyeing: produced using 0.5% of the red disperse dyestuff described in Example 2.

Printing paste: prepared using 25 g/kg of the yellow vat dyestuff C.I. No. 59,100 (Vat Yellow 4).

EXAMPLE 32

A yellow print on a blue background shade.

Dyeing: produced using 0.2% of the blue disperse dyestuff described in Example 13.

Printing paste: prepared using 20 g/kg of the yellow vat dyestuff C.I. No. 59,105 (Vat Orange 1).

EXAMPLE 33

A mixed fabric made of polyester fibers and cotton in the proportions 67/33 is padded with 20 g/l of the red disperse dyestuff of the formula

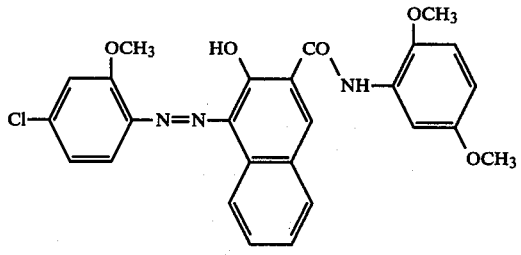

and 80 g/l of thiodiglycol on a padder (liquor pick-up 50%), dried in a hot flue at 100° C. and then printed. The printing paste contains, per kg, 150 g of oxethylated stearyl alcohol (25 moles of ethylene oxide per mole of stearyl alcohol).

After printing, the goods are subjected to thermosol treatment for 2 minutes at 215° C. on a stenter frame and are then washed. This gives a print in which the printed areas are white.

EXAMPLE 34

A mixed fabric made of polyester fibers and cotton in the proportions 67/33 is treated as described in Example 33, using 20 g/l of the blue disperse dyestuff of the formula

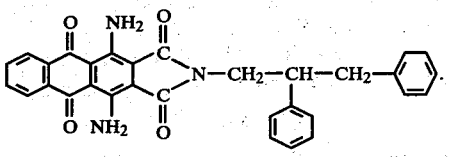

This gives a blue print in which the printed areas are white.

Similar results are obtained if the treatment described above is carried out, but using the dyestuff Disperse Blue 327 instead of the dyestuff mentioned above.

If 40 g/kg of the dyestuff Disperse Red 322 are also added to the printing paste in the last-mentioned case, a red print on a blue background shade is obtained.

EXAMPLE 35

A mixed fabric made of polyester fibers and cotton in the proportion of 67/33 is padded with a dye liquor of the following composition:

8 g/l of an olive-green leuco vat ester dyestuff of C.I. No. 69,501 (Solubilised Vat Green 3),
1.2 g/l of ammonium sulfate,
0.8 g/l of sodium formate and
2 g/l of sodium chlorate.

The liquor pick-up is 50%. After padding, the goods are dried on a hot flue at 100° C. and are then printed with the printing paste used in Example 33. After printing, the goods are subjected to thermosol treatment for 2 minutes at 215° C. on a stenter frame and are then washed.

This gives a print in which the printed areas are white.

EXAMPLE 36

A bleached and mercerized cotton fabric is padded at a liquor pick-up of 70% on a padder and is then dried in a hot flue at 100° C. The padding liquor contains the following products:

20 g/l of Azoic Coupling Component 2, C.I. No. 37,505,
20 ccm/l of 32.5% strength sodium hydroxide solution,
5 g/l of a condensation product formed from partially degraded casein and oleyl chloride and
the remainder water.

After drying, the goods are developed in a bath containing 124 g/l of Azoic Diazo Component 4, C.I. No. 37,210,
124 g/l of urea and
12.4 g/l of an assistant formed from oxethylated castor oil and 36 moles of ethylene oxide.

The goods are then soaped in a washing machine and are then dried. After drying, printing is carried out with the printing paste used in Example 33. After printing, the goods are subjected to thermosol treatment for 2 minutes at 215° C. on a stenter frame and are then washed.

This gives a print in which the printed areas exhibit a considerable lightening in the same color shade.

EXAMPLE 37

A 1.5% strength dyeing is first produced by a known procedure on a cotton fabric, using the olive-green vat dyestuff C.I. 58,830 (Vat Green 14). This dyeing is then printed with a printing paste containing, per kg, 100 g of an oxethylated coconut fatty alcohol (25 moles of ethylene oxide per mole of alcohol). After printing, the fabric is subjected to thermosol treatment for 2 minutes at 210° C. and is then rinsed.

This gives an olive-green dyeing in which the printed areas have been distinctly lightened.

EXAMPLE 38

A mixed fabric made of polyester fibers and cotton in the proportions of 67/33 is padded on a padder with a liquor containing, per liter, 4.6 g of the red disperse dyestuff of the formula

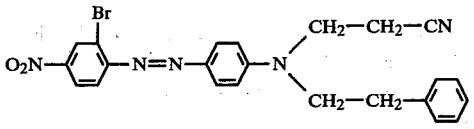

0.4 g of the orange disperse dyestuff of C.I. No. 26,077 (Disperse Orange 29),
1 g of the blue disperse dyestuff of C.I. No. 63,265 (Disperse Blue 73),
14 g of the brown vat dyestuff of C.I. No. 59,500 (Vat Brown 45) and
3 g of a commercially available wetting agent.

The liquor pick-up is 45%. After padding, the fabric is dried at about 120° C. It is then printed with a printing paste containing, per kg, 150 g of an oxethylated stearyl alcohol (25 moles of ethylene oxide per mole of alcohol).

The printed fabric is then subjected to thermosol treatment for 2 minutes at 215° C. The fixing of the disperse dyestuffs on the polyester component of the mixed fabric is effected simultaneously during this treatment.

The fixing of the vat dyestuff on the cotton component is effected subsequently in a known, customary manner by padding with alkali and a reducing agent and then steaming.

Finishing the goods gives a brown dyeing in which the printed areas are white.

What is claimed is:

1. A process for localized white discharging or colored discharging of dyeing on a textile sheet-like article of fibrous structure, which article has been treated by dyeing it to completion with a non-reactive disperse dyestuff, vat dyestuff, or leuco-ester of a vat dyestuff, or impregnating it therewith and drying it without fixing of the dyestuff, which comprises applying to the dyestuff-treated textile sheet-like article in a predetermined pattern a printing paste which, in addition to one or more thickeners, other customary assistants and water, contains an assistant selected from the group consisting of oxethylated fatty acids, oxethylated fatty alcohols and oxethylated alkylphenols and which is a solvent for said dyestuff at elevated temperature but does not destroy the dyestuff by reduction and does not attack the fiber of said textile sheet-like article at thermosol conditions, and subjecting the dyestuff-treated textile sheet-like article, to which the printing paste has been applied, to dry heat at a temperature of from 180° to 220° C.

2. A process as claimed in claim 1, wherein the dyestuff-treated textile sheet-like article is composed of synthetic fibers dyed or impregnated with a disperse dyestuff.

3. A process as claimed in claim 2, wherein the textile sheet-like article is made of polyester fibers.

4. A process as claimed in claim 1, wherein the dyestuff-treated textile sheet-like article is composed of a mixture of natural fibers and synthetic fibers which has been dyed or impregnated with a disperse dyestuff, vat dyestuff or leuco-ester thereof.

5. A process as claimed in claim 4, wherein the textile sheet-like article consists of a mixture of cellulose and polyester fibers.

6. A process as claimed in claim 1, wherein the dyestuff-treated textile sheet-like article to which the printing paste has been applied is subjected to hot air, radiated heat, contact heat, or a combination thereof.

7. A process as claimed in claim 1, 2, 3, 4 or 5, wherein the dyestuff-treated textile sheet-like article, after application of the printing paste thereto, is subjected to a combined dry heat and steam treatment.

8. A process as claimed in claim 1, 2, 3, 4 or 5, wherein the dyestuff-dissolving assistant is a saturated fatty alcohol of from 8 to 18 carbon atoms, which has been oxethylated with 5 to 40 moles of ethylene oxide per mole of alcohol.

9. A process as claimed in claim 1, 2, 3, 4 or 5, wherein a dyestuff resistant to discharging, and of the same category as the dyestuff employed to effect the background dyeing, is present in the printing paste to achieve colored discharging.

10. A process as claimed in claim 1, 2, 3, 4 or 5, wherein a dyestuff resistant to discharging, and of a category different from that of the dyestuff employed to effect the background dyeing, is present in the printing paste to achieve colored discharging.

* * * * *